US012533560B2

(12) United States Patent
Osborne et al.

(10) Patent No.: US 12,533,560 B2
(45) Date of Patent: Jan. 27, 2026

(54) HYBRID GOLF ACCESSORY AND METHOD(S) OF USE THEREOF

(71) Applicants: Nathan Osborne, Centennial, CO (US); Robert Batchelor, Greenwood Village, CO (US)

(72) Inventors: Nathan Osborne, Centennial, CO (US); Robert Batchelor, Greenwood Village, CO (US)

( * ) Notice: Subject to any disclaimer, the term of this patent is extended or adjusted under 35 U.S.C. 154(b) by 82 days.

(21) Appl. No.: 18/446,796

(22) Filed: Aug. 9, 2023

(65) Prior Publication Data

US 2024/0075361 A1 Mar. 7, 2024

Related U.S. Application Data

(60) Provisional application No. 63/403,691, filed on Sep. 2, 2022.

(51) Int. Cl.
*A63B 57/10* (2015.01)
*A45F 3/18* (2006.01)

(52) U.S. Cl.
CPC ..... *A63B 57/10* (2015.10); *A45F 3/18* (2013.01)

(58) Field of Classification Search
CPC ..... A63B 57/10; A63B 3/18; A63B 57/203; A45F 3/18
USPC ..... D21/717
See application file for complete search history.

(56) References Cited

U.S. PATENT DOCUMENTS

| | | | | | |
|---|---|---|---|---|---|
| 1,617,232 | A * | 2/1927 | Butler | A63B 57/10 473/392 |
| 2,033,269 | A * | 3/1936 | Williams | A63B 57/19 473/278 |
| D266,860 | S * | 11/1982 | Nelson | D21/717 |
| D301,003 | S * | 5/1989 | Burns | D7/515 |
| D302,633 | S * | 8/1989 | Burns | D7/515 |
| D313,534 | S * | 1/1991 | Stadtmueller | D7/506 |
| D349,318 | S * | 8/1994 | Rubin | D21/718 |
| D370,829 | S * | 6/1996 | Neale | D7/533 |
| 6,200,233 | B1 * | 3/2001 | Moody | A63B 57/10 473/387 |
| D778,379 | S * | 2/2017 | Westrom | D21/717 |
| D895,363 | S * | 9/2020 | Shin | D9/668 |
| D1,036,587 | S * | 7/2024 | Aronson | D21/717 |
| 2007/0066422 | A1 * | 3/2007 | Cirone | A63B 57/10 473/387 |
| 2009/0264225 | A1 * | 10/2009 | Lee | A63B 57/10 473/387 |
| 2023/0302338 | A1 * | 9/2023 | Rubac | A63B 57/15 |

FOREIGN PATENT DOCUMENTS

| | | | | |
|---|---|---|---|---|
| KR | 20110123966 A | * | 11/2011 | |
| KR | 20130002139 U | * | 4/2013 | |
| WO | WO-0230524 A1 | * | 4/2002 | A63B 57/0037 |

* cited by examiner

*Primary Examiner* — Steven B Wong
(74) *Attorney, Agent, or Firm* — Leyendecker & Lemire, LLC

(57) ABSTRACT

A hybrid golf accessory and method of use thereof is described. Embodiments of the hybrid golf accessory can include a drinking vessel and a golf tee guide integrated with the drinking vessel.

11 Claims, 3 Drawing Sheets

HYBRID GOLF ACCESSORY AND METHOD(S) OF USE THEREOF

CROSS-REFERENCE TO RELATED APPLICATION

This application claims the benefit of U.S. Provisional Application No. 63/403,691, filed Sep. 2, 2022.

BACKGROUND

Shot glasses are traditionally miniaturized drinking glasses for consuming alcohol from. More specifically, shot glasses are used to serve small amounts of liquor to be quickly consumed by a user. Golfers use a golf tee to elevate a golf ball off of a playing surface when hitting from a tee box. The golf tee allows for clean contact with a club face where drivers have grown in size over the years.

A hybrid golf accessory that allows for a user to implement a shot glass as a golf tee guide is needed.

DETAILED DESCRIPTION

Figure 1A:
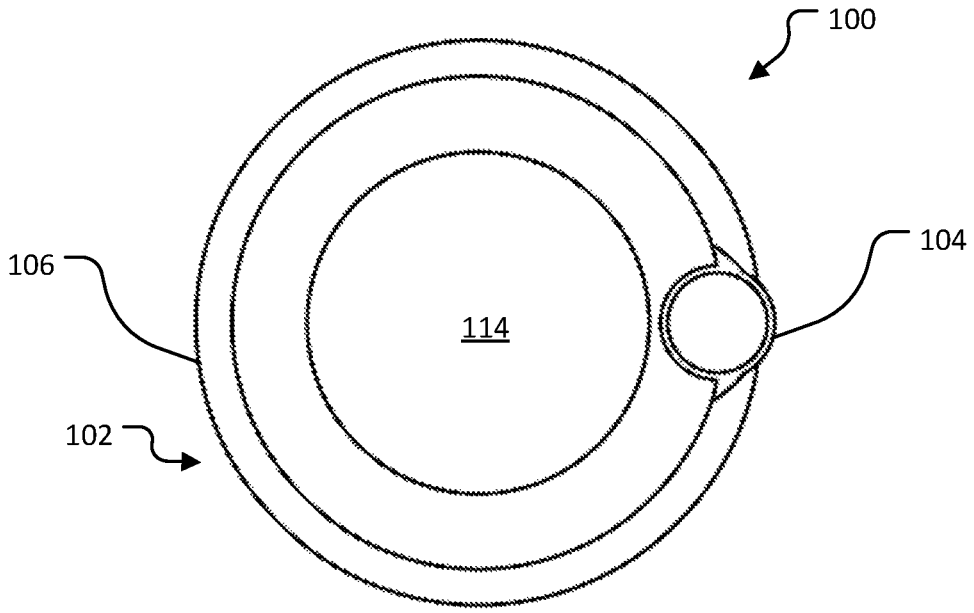
FIG. 1A is a top view of a hybrid golf accessory according to one embodiment of the present invention.

Embodiments of the present invention include a hybrid golf accessory and method(s) of use thereof. In general, the hybrid golf accessory can be implemented as a shot glass and a golf tee guide. In one embodiment, the hybrid golf accessory can include, but is not limited to, a drinking vessel and a golf tee guide. The drinking vessel can be defined by a body having a cavity. In one instance, the golf tee guide can be defined by a tube integrated into a peripheral wall of the body. Typically, the tube can be integrated into a structure of the body of the drinking vessel and can be configured to receive a portion of a golf tee therethrough. As can be appreciated, the golf tee tube can be configured to receive a golf tee therethrough such that an end of the golf tee can be inserted into the ground after passing through the golf tee tube when the drinking vessel may be placed on a playing surface. A user may then place their golf ball on the tee and proceed to hit a tee shot. The drinking vessel can include the cavity for receiving liquid therein.

In one embodiment, the body of the drinking vessel can have a similar appearance to a single shot glass. Of note, a shape of the body can be altered without exceeding a scope of the present invention. Typically, a bottom surface of the body can be flat. An upper surface of the body may also be flat such that a user can implement the hybrid golf accessory in two orientations. In one instance, the body may appear to be similar to a beer mug. Typically, the cavity of the drinking vessel can be sized to hold approximately 1-2 fluid ounces of liquid.

In one embodiment, the body of the drinking vessel may be defined by a sidewall and a base attached thereto. The sidewall may have a generally frustoconical shape, but variations of the shape may be cylindrical, barrel shaped, etc. In another embodiment, the body of the drinking vessel can generally be defined by a circumferential wall connected to a base. The circumferential wall can be cylindrical in shape with a diminishing diameter or taper progressing from a top of the drinking vessel to the base. As can be appreciated, a diameter of a bottom of the drinking vessel may be smaller than a diameter of a top of the drinking vessel. The circumferential wall may have other configurations which may not be tapered and/or cylindrical.

In general, the golf tee tube can be integrated into a periphery wall of the body of the drinking vessel. Of note, the golf tee tube can be oriented substantially vertical such that a golf tee would be vertical after a portion of the golf tee passes through the tube. In this configuration, the golf tee tube can guide a golf tee to be substantially vertical. Stated alternatively, the tube can be oriented in the peripheral wall of the body such that a tee passed through the tube would be substantially perpendicular to a playing surface the drinking vessel may be resting on. In some instances, when the body tapers from a top towards the bottom, a portion of the top of the tube may be protruding into an interior of the cavity and then the tube can pass through the body to outside an exterior wall of the body towards a bottom of the drinking vessel.

Generally, the drinking vessel can be made from a semi-rigid material to provide rigidity but also pliability and shock absorption for when a golf ball is hit from a tee inserted into the tube of the drinking vessel. In some instances, the golf tee tube may be comprised of a different material than the body. For example, the golf tee tube may be made from a rigid material and the body may be made from a semi-rigid material. The drinking vessel can be manufactured from, but is not limited to, plastics, silicones, and/or rubber (synthetic and natural). Of note, the golf tee can pass through the golf tee tube of the drinking vessel leaving a portion of the golf tee to be inserted into a playing surface. In most instances, the golf tee can be substantially vertical such that the golf ball may rest on the golf tee and not fall off.

In a typical implementation, a user may first set the drinking vessel on a playing surface. The user may then insert the golf tee through the golf tee tube. In some instances, the user may first insert a golf tee into the golf tee tube and then place the drinking vessel and golf tee on a playing surface. The user can next push the tee down to penetrate the playing surface such that a portion of the golf tee inserts into the playing surface. The user can then place a golf ball on the golf tee and proceed to hit a tee shot. In some instances, a user may drink from the drinking vessel before implementing it with a golf tee. In other instances, the user may hit a tee shot and the proceed to fill the cavity of the drinking vessel with a liquid and drink therefrom. In yet other instances, a user may fill the cavity of the drinking vessel and proceed to a hit a tee shot before consuming the contents of the drinking vessel.

Of note, the drinking vessel can be oriented upright or upside down as the golf tee can pass through from the top of the drinking vessel towards the bottom or vice versa. For instance, a user may drink from the drinking vessel and then flip it upside down and pass the golf tee through the golf tee tube while the drinking vessel lays on a playing surface. As can be appreciated, in embodiments where a top of the drinking vessel has a larger diameter than the bottom, the drinking vessel may be more stable when resting on a surface upside down. A distance the golf tee inserts into the playing surface can depend on a length of the golf tee and preference of the user.

In one embodiment, a hybrid golf accessory can include, but is not limited to, a drinking vessel and a golf tee guide. The drinking vessel can be defined by a body having a bottom surface and a sidewall forming a cavity. The sidewall can extend upwardly from the bottom surface. The golf tee guide can be integrated into the sidewall of the body. The golf tee tube can be defined by a tube extending from a top of the body to the bottom surface. The tube can be adapted to receive a golf tee therethrough.

In one embodiment, a method of using a hybrid golf accessory can include one or more of the following steps. First, providing a hybrid golf accessory. The hybrid golf accessory can include, but is not limited to, a drinking vessel and a golf tee guide. The drinking vessel can be defined by a bottom surface and a sidewall forming a cavity, the sidewall extending upwardly from the bottom surface. The golf tee guide can be integrated into the sidewall of the body. The golf tee guide can be defined by a tube extending from a top of the body to the bottom surface. Second, placing the drinking vessel on a playing surface. Third, inserting a tee through the tube and into the playing surface. The method may further include the steps of placing a golf ball on the tee and hitting the golf ball off of the tee inserted into the golf tee guide of the drinking vessel.

In another embodiment, the method may include the previously mentioned steps. However, the hybrid golf accessory may include a drinking vessel and a golf tee guide. The drinking vessel may have a body defined by a base and a circumferential sidewall extending up from the base. The body can have a substantially frustoconical shape. The golf tee guide can be integrated into the sidewall of the body. The golf tee guide can be defined by a tube being vertically oriented and passing at least partially through the circumferential sidewall.

In one embodiment, the drinking vessel can include, but is not limited to, a body having a cavity and a tube integrated into a peripheral wall of the body. The tube can be configured to receive a portion of a golf tee therethrough. The body can include the cavity for receiving and containing a fluid therein. Generally, an interior diameter of the golf tee tube can be smaller than a diameter of a head of a golf tee such that an entire golf tee does not pass all the way through the tube.

In one method of use, a user can implement the drinking vessel as a shot glass and then use the drinking vessel as a guide for a golf tee such that a user can hit a tee shot from the drinking vessel with a golf tee passed through the tube. In a first step, a user can set the drinking vessel on a playing surface. In a second step, the user can insert the golf tee through the golf tee tube. In a third step, the user can push the tee down to penetrate the playing surface such that a portion of the golf tee inserts into the playing surface. In a fourth step, the user can place a golf ball on the golf tee. In a fifth step, the user can proceed to hit a tee shot.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment", "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Hybrid Golf Accessory

Referring to FIGS. 1A-1D, detailed diagrams of an embodiment 100 of a hybrid golf accessory are illustrated. The hybrid golf accessory 100 can typically be used during a round of golf. The hybrid golf accessory 100 can typically include a drinking vessel and a golf tee guide. The golf tee guide can be implemented to allow for a golf tee to pass through the drinking vessel and penetrate a playing surface. In some instances, the golf tee guide can be integrated into a body of the drinking vessel. In other instances, the golf tee guide may be removably coupled to the drinking vessel.

Figure 1B:
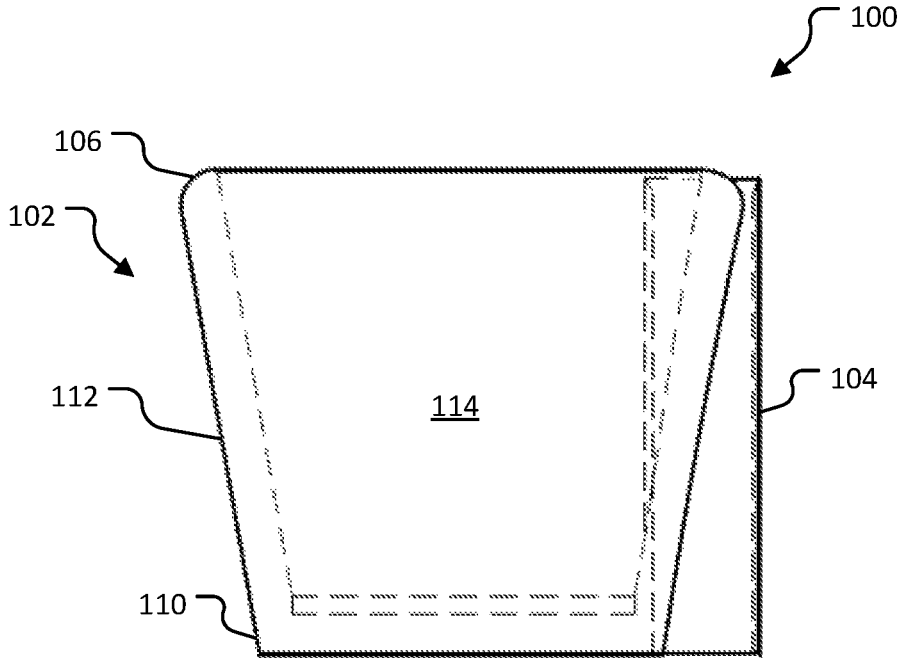
FIG. 1B is a front view of a hybrid golf accessory according to one embodiment of the present invention.
Figure 1C:
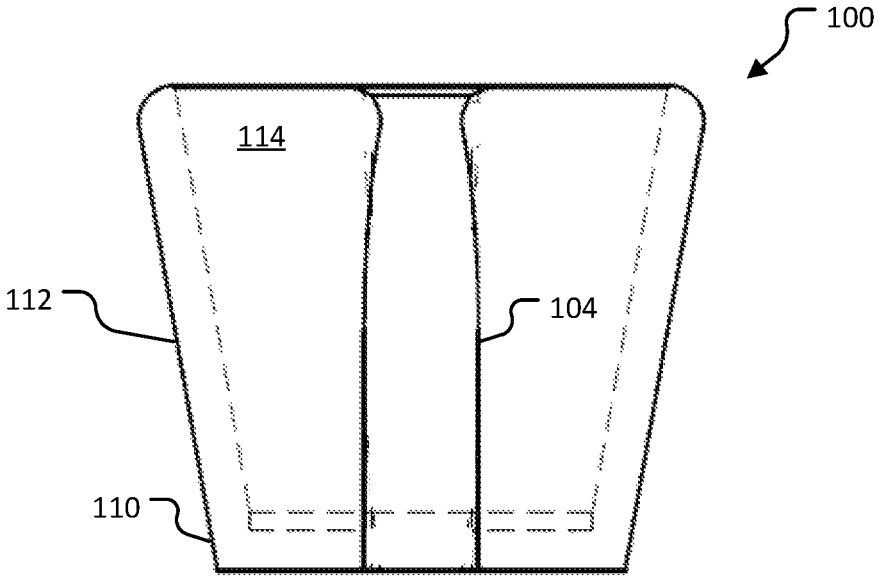
FIG. 1C is a side view of a hybrid golf accessory according to one embodiment of the present invention.
Figure 1D:
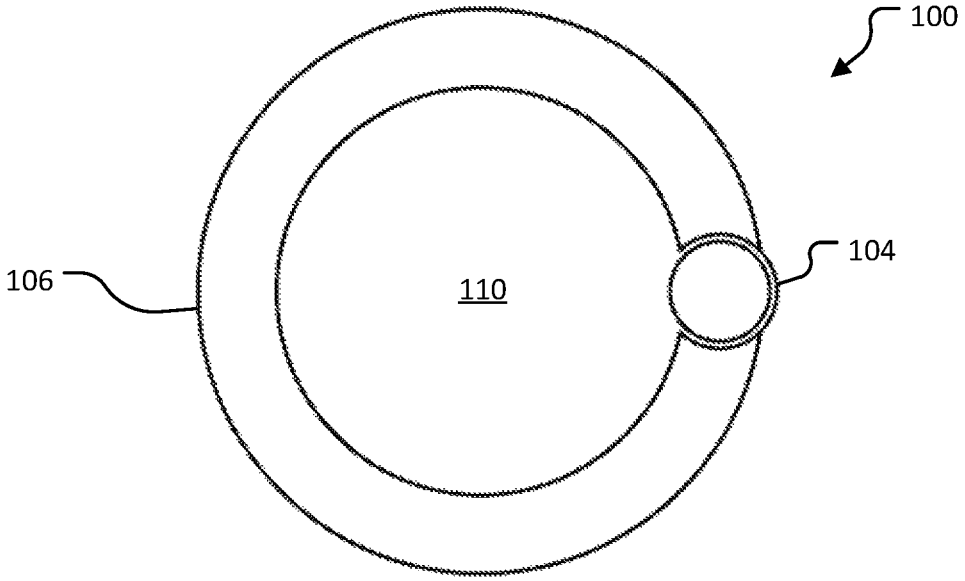
FIG. 1D is a bottom view of a hybrid golf accessory according to one embodiment of the present invention.

FIG. 1A includes a top view of the hybrid golf accessory 100. FIG. 1B includes a front view of the hybrid golf accessory 100. FIG. 1C includes a side view of the hybrid golf accessory 100. FIG. 1D includes a bottom view of the hybrid golf accessory 100.

As shown generally in FIGS. 1A-1D, the hybrid golf accessory 100 can include, but is not limited to, a drinking vessel 102 and a golf tee guide 104. In most instances, the golf tee guide 104 can be integrated with the drinking vessel 102. Embodiments are contemplated where the golf tee guide 104 may be removably coupled to the drinking vessel 102. Of note, an integration of the golf tee guide 104 with the drinking vessel 102 does not interfere with a use of the hybrid golf accessory 100 as a drinking vessel or golf tee guide.

In one embodiment, the drinking vessel 102 can be defined by a body 106 having a base 110, a sidewall 112, and a cavity 114. In one instance, the sidewall 112 can extend circumferentially up from the base 110 in a generally frustoconical shape. In general, the sidewall 112 can extend upwards from the base 110. The cavity 114 can be sized to receive approximately 1-2 fluid ounces therein. A bottom surface of the base 110 can generally be flat to interface with a playing surface. Instances are contemplated where the base 110 may have at least a flat perimeter such that the drinking vessel 102 may rest on a playing surface without tipping over.

The golf tee guide 104 can generally be defined by a tube with a first opening proximate a top of the drinking vessel 102 and a second opening proximate a bottom of the drinking vessel 102. The golf tee guide 104 can be sized to receive a standard sized golf tee therethrough. As generally shown, the golf tee guide 104 can be oriented substantially vertical. As can be appreciated, by being oriented vertically, a tee passed through the golf tee guide 104 may also be oriented substantially vertical allowing for a golf ball to rest on top of the golf tee.

Figure 2A:
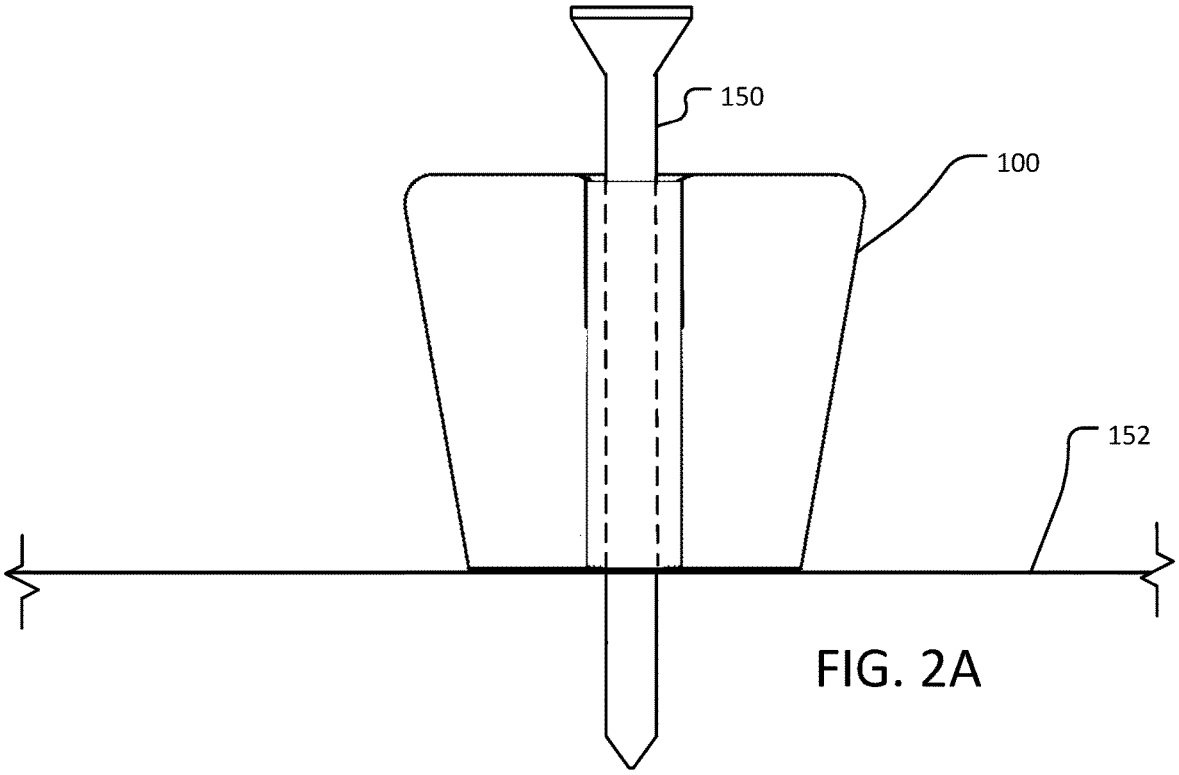
FIG. 2A is a front view of a hybrid golf accessory and a golf tee according to one embodiment of the present invention.
Figure 2B:
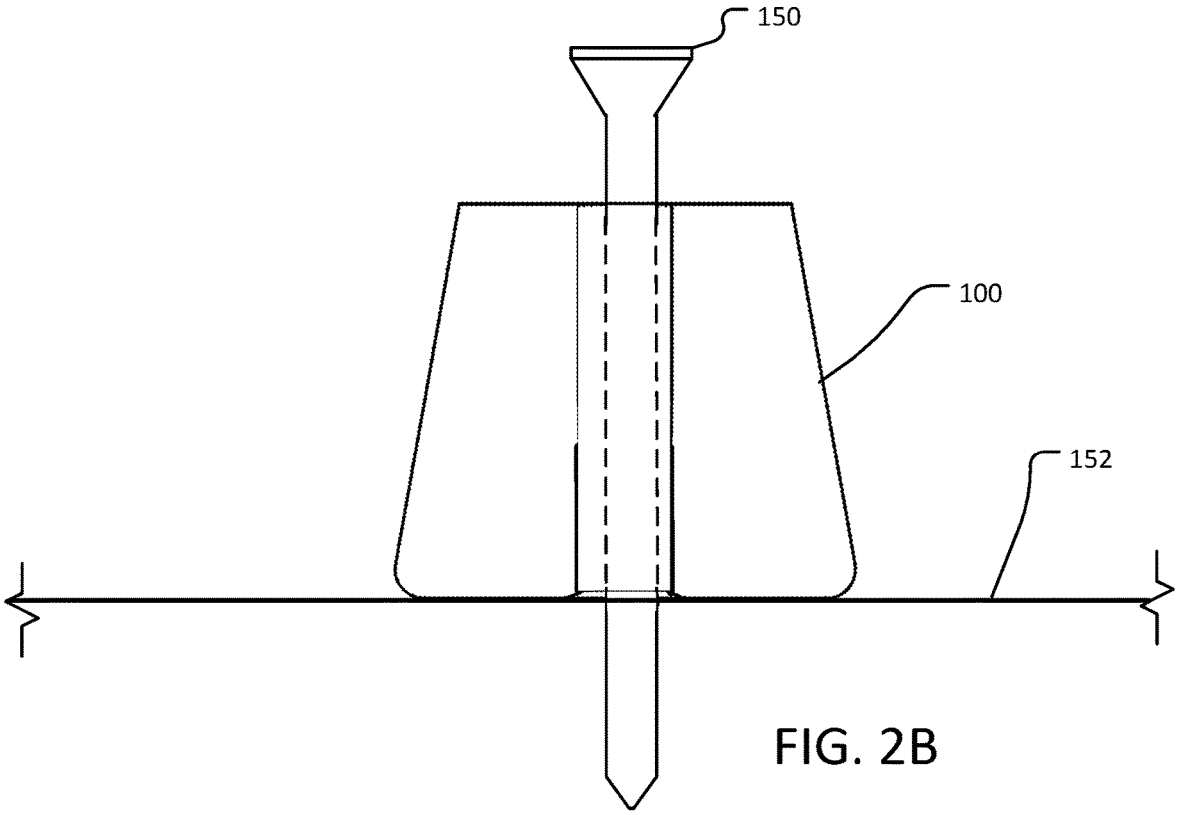
FIG. 2B is a front view of a hybrid golf accessory and a golf tee according to one embodiment of the present invention.

Referring to FIGS. 2A-2B, detailed diagrams of the hybrid golf accessory 100 in combination with a golf tee 150 resting on a playing surface 152 are illustrated. As shown, the golf tee 150 can be passed through the golf tee guide 104 and penetrate the playing surface 152. Generally, the playing surface 152 can be a typical tee box found on every golf course. Referring to FIG. 2A, a detailed diagram of the hybrid golf accessory 100 resting on the playing surface 152 in an upright orientation is illustrated. Referring to FIG. 2B, a detailed diagram of the hybrid golf accessory 100 resting on the playing surface 152 in an upside-down configuration is illustrated. As can be appreciated, a user may use the hybrid golf accessory 100 in an upright orientation or and upside-down orientation.

ALTERNATIVE EMBODIMENTS AND VARIATIONS

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

Embodiments of the golf tee guide are contemplated that include a ring attached to the base of the drinking vessel and a bore passing partially through the sidewall of the drinking vessel. The ring can be aligned concentrically with the bore such that a golf tee would pass through the bore and then through the ring and penetrate a playing surface. Embodiments are further contemplated where the golf tee guide can be located exteriorly to the sidewall of the drinking vessel.

We claim:

1. A method of using a hybrid golf accessory, the method comprising:

providing a hybrid golf accessory, the hybrid golf accessory comprising:

a drinking vessel having a body defined by a bottom surface and a sidewall forming a cavity, the sidewall extending upwardly from the bottom surface; and a golf tee guide integrated into the sidewall of the body, the golf tee guide defined by a tube extending from a top of the body to the bottom surface;

placing the drinking vessel on a playing surface; and inserting a tee through the tube and into the playing surface;

wherein (i) a lower portion of the tube is located outside the sidewall, and (ii) an upper portion of the tube protrudes into the cavity.

2. The method of claim 1, further comprising the steps of:

placing a golf ball on the tee; and hitting the golf ball off of the tee inserted into the golf tee guide of the drinking vessel.

3. The method of claim 1, wherein the body is manufactured from a semi-rigid material.

4. The method of claim 3, wherein the tube is manufactured from a rigid material.

5. The method of claim 3, wherein the tube is manufactured from a semi-rigid material.

6. The method of claim 1, wherein a top of the drinking vessel has a larger diameter than a bottom of the drinking vessel.

7. A method of using a hybrid golf accessory comprising:

providing a hybrid golf accessory, the hybrid golf accessory defined by:

a drinking vessel having a body defined by a base and a circumferential sidewall extending up from the base, the body having a substantially frustoconical shape; and a golf tee guide integrated into the sidewall of the body, the golf tee guide defined by a tube being vertically oriented and passing at least partially through the circumferential sidewall;

placing the hybrid golf accessory on a playing surface; and inserting a tee through the tube and into the playing surface;

wherein a top surface of the drinking vessel interfaces with the playing surface in a first orientation.

8. The method of claim 7, wherein a bottom surface of the drinking vessel interfaces with the playing surface in a second orientation.

9. The method of claim 7, wherein the golf tee guide is integral to the body.

10. The method of claim 7, wherein a thickness of the sidewall is more than an interior diameter of the golf tee guide.

11. The method of claim 7, wherein a thickness of the sidewall is equal to an interior diameter of the golf tee guide.

* * * * *